US010065832B2

(12) United States Patent
Kubota

(10) Patent No.: US 10,065,832 B2
(45) Date of Patent: Sep. 4, 2018

(54) ELEVATOR CONTROL APPARATUS

(71) Applicant: MITSUBISHI ELECTRIC CORPORATION, Chiyoda-ku (JP)

(72) Inventor: Takehiko Kubota, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 380 days.

(21) Appl. No.: 14/916,456

(22) PCT Filed: Sep. 27, 2013

(86) PCT No.: PCT/JP2013/076264
§ 371 (c)(1),
(2) Date: Mar. 3, 2016

(87) PCT Pub. No.: WO2015/045096
PCT Pub. Date: Apr. 2, 2015

(65) Prior Publication Data
US 2016/0194180 A1 Jul. 7, 2016

(51) Int. Cl.
*B66B 1/32* (2006.01)
*B66D 5/08* (2006.01)
(Continued)

(52) U.S. Cl.
CPC ..... *B66B 1/32* (2013.01); *B66B 5/02* (2013.01); *B66D 5/08* (2013.01); *B66D 5/30* (2013.01)

(58) Field of Classification Search
CPC .... B66B 1/32; B66B 5/02; B66B 5/08; B66B 5/30
(Continued)

(56) References Cited

U.S. PATENT DOCUMENTS 4,458,290 A * 7/1984 Miyashita ..... H02P 3/04 361/152
4,545,464 A * 10/1985 Nomura ..... B66B 1/30 187/296
(Continued)

FOREIGN PATENT DOCUMENTS

JP 5-90928 A 4/1993
JP 5-219770 A 8/1993
(Continued)

OTHER PUBLICATIONS

Office Action dated Sep. 13, 2016 in Japanese Patent Application No. 2015-538736 (with English language translation).
(Continued)

*Primary Examiner* — Anthony Salata
(74) *Attorney, Agent, or Firm* — Xsensus, LLP

(57) ABSTRACT

In an elevator control apparatus, a DC-DC converter including a first switching element and a second switching element is configured to generate power for driving an elevator brake by alternately operating each of the first switching element and the second switching element. A first photocoupler and a second photocoupler are configured to independently operate the first switching element and the second switching element, respectively. A first calculation unit and a second calculation unit are configured to independently control power supply voltages of the first photocoupler and the second photocoupler, respectively.

2 Claims, 6 Drawing Sheets

(51) Int. Cl.
*B66D 5/30* (2006.01)
*B66B 5/02* (2006.01)

(58) Field of Classification Search
USPC ..... 187/247, 288, 289, 290, 293, 296, 297, 187/391, 393; 318/799–815
See application file for complete search history.

(56) References Cited

U.S. PATENT DOCUMENTS 5,225,754 A * 7/1993 Eckersley ..... B66B 1/30 187/293
6,056,088 A * 5/2000 Gerstenkorn ..... B66B 5/0031 187/390
7,350,624 B2 * 4/2008 Deplazes ..... B66B 13/22 187/316
7,575,102 B2 * 8/2009 Matsuoka ..... B66B 5/0093 187/391
7,740,110 B2 * 6/2010 Kattainen ..... B66B 1/32 187/288
8,584,812 B2 * 11/2013 Dorsch ..... B66B 5/0031 187/287
8,820,484 B2 * 9/2014 Rui ..... B66B 1/32 187/288
9,367,416 B2 * 6/2016 Hovi ..... B66B 5/0031
9,776,829 B2 * 10/2017 Kattainen ..... B66B 1/32
9,873,591 B2 * 1/2018 Kattainen ..... B66B 5/02
2010/0032246 A1 2/2010 Kattainen et al.
2010/0038185 A1 2/2010 Kattainen et al.
2011/0094837 A1 4/2011 Gewinner et al.
2015/0073599 A1 3/2015 Yasuda et al.

FOREIGN PATENT DOCUMENTS

JP 5-243950 A 9/1993
JP 2005-168199 A 6/2005
JP 2008-213952 A 9/2008
JP 2009-46231 A 3/2009
JP 2010-523434 A 7/2010
JP 2011-524319 A 9/2011
JP 2011-195287 A 10/2011
JP 2013-184489 A 9/2013
WO 2008/119870 A1 10/2008
WO 2009/154591 A1 12/2009
WO 2014/013554 A1 1/2014

OTHER PUBLICATIONS

International Search Report dated Jan. 7, 2014 in PCT/JP2013/076264 filed Sep. 27, 2013.

* cited by examiner

ELEVATOR CONTROL APPARATUS

TECHNICAL FIELD

The present invention relates to an elevator control apparatus for controlling a power supply to an elevator brake.

BACKGROUND ART

In general, for an elevator hoisting machine brake, a braking force is produced by cutting the power supply to a brake coil by an electromagnetic switch. When there is only one electromagnetic switch, in a case where an ON failure of the electromagnetic switch occurs, the brake cannot perform a braking operation. Therefore, in order for the brake to reliably perform a braking operation, a plurality of electromagnetic switches are needed.

Hitherto, an elevator brake safety control apparatus has been proposed in which operation of a semiconductor switch in a primary-side circuit of a direct current (DC)-DC converter for supplying power to a brake coil is controlled by a pulse-width modulation controller so that the power supply of the pulse-width modulation controller is cut at a plurality of safety relay contact points when an abnormality occurs in the elevator (refer to Patent Literature 1).

CITATION LIST

Patent Literature

[PTL 1] JP 2011-524319 A

SUMMARY OF INVENTION

Technical Problem

However, with a related-art elevator brake safety control apparatus, the cutting of the power supply of the pulse-width modulation controller is performed at the safety relay contact points, and hence a contact failure may occur at the safety relay contact points. In this case, it is more difficult to correctly control operation of the brake. Further, operating noise is produced by operation of the safety relay contact points, and hence it is more difficult to reduce unwanted noise. In addition, due to the presence of the safety relay contact points, it is more difficult to reduce circuit size.

The present invention has been created in order to solve the above-mentioned problems. It is an object of the present invention to provide an elevator control apparatus capable of controlling operation of a brake more reliably, capable of preventing production of unwanted noise, and that is more compact.

Solution to Problem

An elevator control apparatus according to one embodiment of the present invention includes: a DC-DC converter including a first switching element and a second switching element, for generating power for driving an elevator brake by alternately operating each of the first switching element and the second switching element; a first photocoupler and a second photocoupler for independently operating the first switching element and the second switching element, respectively; and a first calculation unit and a second calculation unit for independently controlling power supply voltages of the first photocoupler and the second photocoupler, respectively.

Advantageous Effects of Invention

According to the elevator control apparatus of the one embodiment of the present invention, the operation of the brake may be controlled more reliably, the production of unwanted noise may be prevented, and the size reduction may be achieved.

DESCRIPTION OF EMBODIMENTS

Now, exemplary embodiments of the present invention are described with reference to the drawings.

First Embodiment

Figure 1:
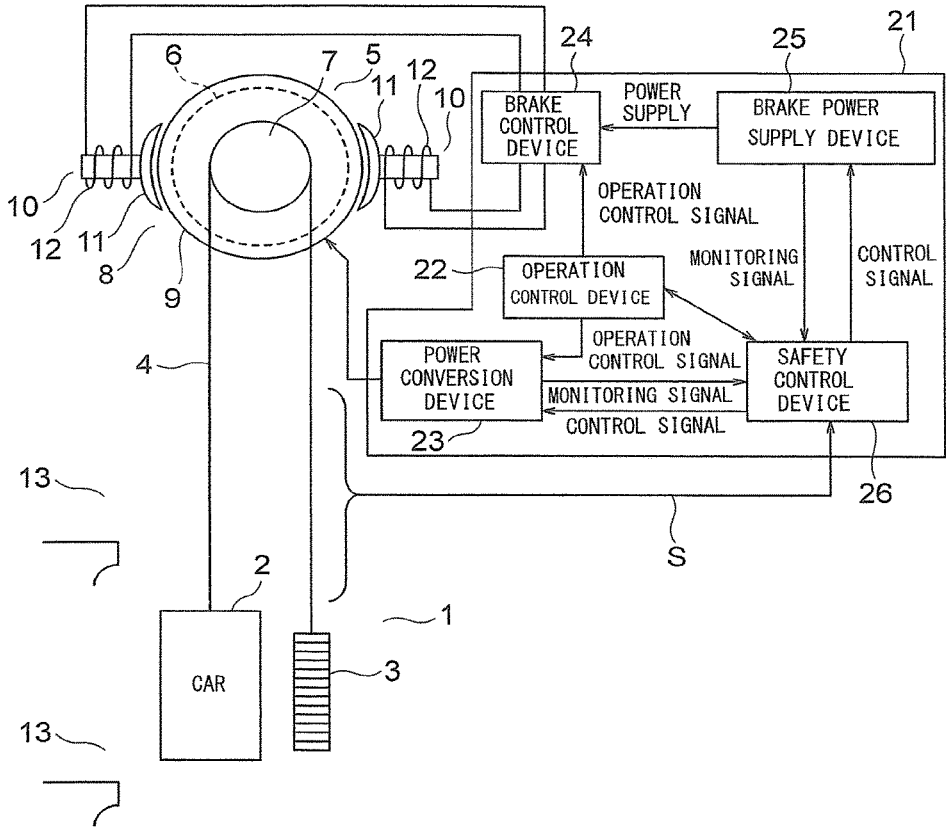
FIG. 1 is a configuration diagram for illustrating an elevator according to a first embodiment of the present invention.

FIG. 1 is a configuration diagram for illustrating an elevator according to a first embodiment of the present invention. In FIG. 1, a car 2 and a counterweight 3 are suspended by a main cable 4 in a hoistway 1. As the main cable 4, for example, a rope, a belt, or the like is used. At an upper portion of the hoistway 1, a hoisting machine 5 for producing a driving force for moving the car 2 and the counterweight 3 is arranged.

The hoisting machine 5 includes a hoisting machine main body 6 including a motor, a drive sheave 7 rotatably arranged on the hoisting machine main body 6, and a brake 8 for applying a braking force on the drive sheave 7.

The main cable 4 is wound around the drive sheave 7. The drive sheave 7 is rotated by a driving force of the motor in the hoisting machine main body 6. The car 2 and the counterweight 3 are moved in up and down directions in the hoistway 1 by the rotation of the drive sheave 7.

The brake 8 includes a rotating body 9 configured to rotate integrally with the drive sheave 7, and a plurality of brake main bodies 10 (in this example, two). The brake main bodies 10 are arranged separated from each other in the rotational direction of the rotating body 9, and each of the brake main bodies 10 is configured to apply a braking force on the rotating body 9.

Each brake main body 10 includes a brake shoe (braking body) 11 capable of being brought into contact with and separated from the rotating body 9, a pressing spring (urging member) (not shown) for urging the brake shoe 11 in a direction for contacting the rotating body 9, and a brake coil (electromagnetic coil) 12 for producing from a power supply an electromagnetic force in a direction for separating the brake shoe 11 from the rotating body 9.

The brake shoe 11 is configured to separate from the rotating body 9 in resistance to the urging force of the pressing spring when power is supplied to the brake coil 12, and to be pressed against the rotating body 9 in conformity with the urging force of the pressing spring when power to the brake coil 12 is cut. A braking force is applied to the car 2 and the drive sheave 7 by the brake shoe 11 being pressed against the rotating body 9. Further, the braking force on the car 2 and the drive sheave 7 is released by the brake shoe 11 separating from the rotating body 9.

A control apparatus 21 for controlling operation of the elevator is arranged in the hoistway 1. The control apparatus 21 includes an operation control device 22, a power conversion device 23, a brake control device 24, a brake power supply device 25, and a safety control device 26.

The operation control device 22 is configured to send an operation control signal for controlling operation of the motor in the hoisting machine main body 6 to the power conversion device 23, and send an operation control signal for controlling operation of the brake 8 to the brake control device 24.

The power conversion device 23 is configured to control the power supply to the motor in the hoisting machine main body 6 based on the operation control signal from the operation control device 22. Operation of the motor in the hoisting machine main body 6 is controlled by controlling the power supply from the power conversion device 23.

The brake control device 24 is configured to individually control the power supply to each brake coil 12 based on the operation control signal from the operation control device 22. Operation of each brake shoe 11 is individually controlled by controlling the power supply to each brake coil 12 by the brake control device 24.

The brake power supply device 25 is configured to supply to the brake control device 24 electric power for the power supply to each brake coil 12 (i.e., electric power for operating the brake 8).

The safety control device 26 is configured to output a control signal to the power conversion device 23 and to the brake power supply device 25. The power supply to the motor in the hoisting machine main body 6 by the power conversion device 23 is enabled by the power conversion device 23 receiving the control signal. Further, the power supply to the brake control device 24 by the brake power supply device 25 is enabled by the brake power supply device 25 receiving the control signal.

The power conversion device 23 and the brake power supply device 25 are each configured to output, when the control signal from the safety control device 26 is received, a monitoring signal based on the control signal to the safety control device 26. The safety control device 26 is configured to determine whether or not an abnormality has occurred in each of the power conversion device 23 and the brake power supply device 25 by monitoring the monitoring signal from each of the power conversion device 23 and the brake power supply device 25.

Further, the elevator includes a safety circuit having a plurality of detection devices connected in series thereto. Examples of the detection devices include a plurality of door switches for detecting an open/closed state of a car entrance of the car 2 and an open/closed state of a landing entrance 13 at each floor, an emergency stop switch for detecting operation of an emergency stop device mounted to the car 2, and a speed governor switch for detecting overspeed of the car 2. When all of the detection devices are normal, an electric safety chain signal S is input from the safety circuit to the safety control device 26. When an abnormality has occurred in at least any one of the detection devices (e.g., when the door is detected as being open by the door switch of the car 2 while the car 2 is moving), the safety circuit is cut, and the input of the electric safety chain signal S to the safety control device 26 is stopped. The safety control device 26 is configured to determine whether or not an abnormality has occurred in the state of the elevator based on whether or not the electric safety chain signal S is being input.

The safety control device 26 is configured to stop output of the control signal to each of the power conversion device 23 and the brake power supply device 25 when an abnormality has occurred in at least any one of the state of the elevator based on the electric safety chain signal S, the power conversion device 23, and the brake power supply device 25. When output of the control signal to each of the power conversion device 23 and the brake power supply device 25 is stopped, the power supply to the motor in the hoisting machine main body 6 and the power supply to each brake coil 12 are stopped.

Figure 2:
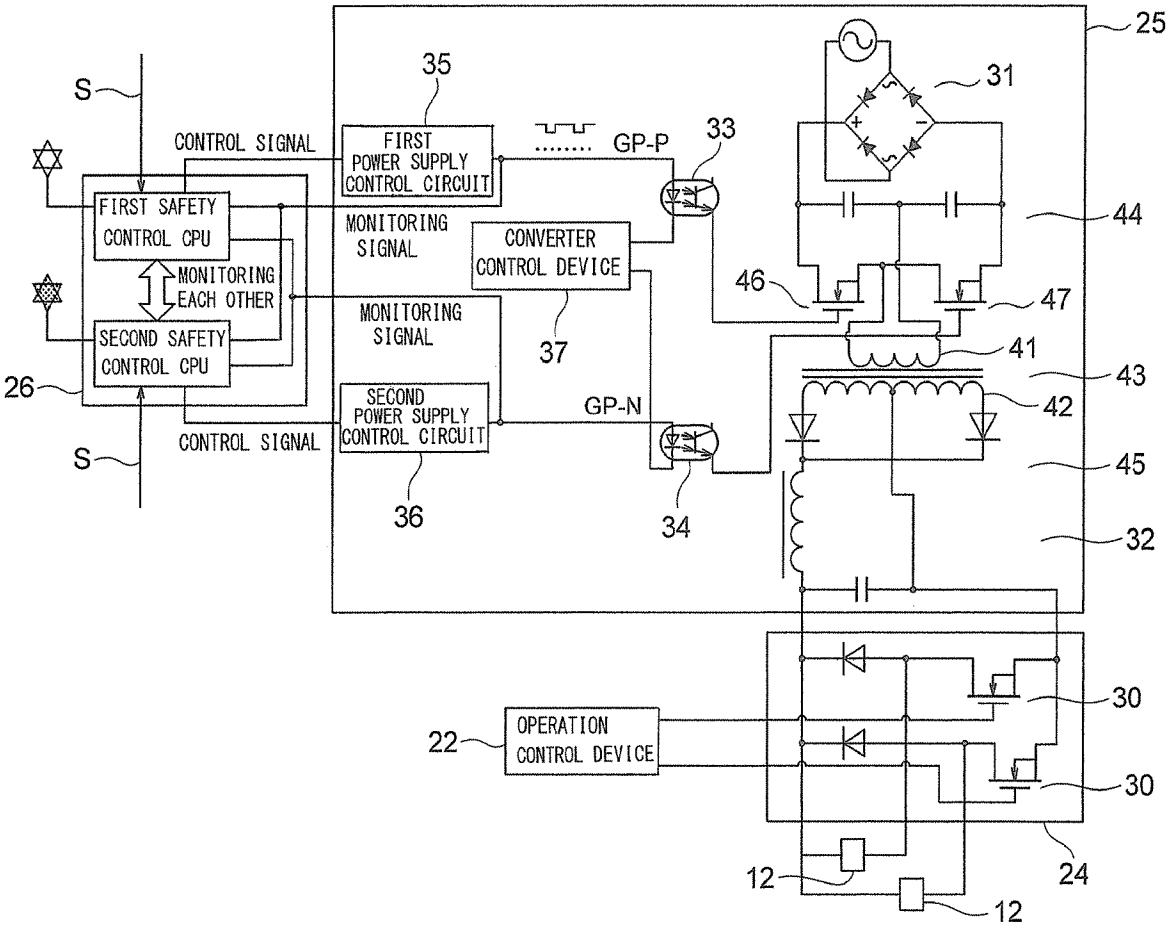
FIG. 2 is a configuration diagram for illustrating a brake control device, a brake power supply device, and a safety control device illustrated in FIG. 1.

FIG. 2 is a configuration diagram for illustrating the brake control device 24, the brake power supply device 25, and the safety control device 26 illustrated in FIG. 1. The brake control device 24 includes the same number of transistors (switching elements) 30 as the number of brake coils 12 (in this example, two). Further, the brake control device 24 is configured to individually perform an ON/OFF operation of each transistor 30 based on the operation control signal from the operation control device 22. The brake control device 24 is capable of individually supplying output power of the brake power supply device 25 to each brake coil 12 by individually performing an ON operation of each transistor 30.

The brake power supply device 25 includes a power conversion unit 31 for converting commercial alternating-current power into direct-current power, a half-bridge DC-DC converter 32 for converting direct-current power from the power conversion unit 31 into direct-current power for supply to each brake coil 12, and first and second photocouplers 33 and 34 each for outputting a drive signal for operating the DC-DC converter 32. The brake power supply device 25 also includes first and second power supply control circuits 35 and 36 for controlling power supply voltages of the first and second photocouplers 33 and 34, respectively, and a converter control device 37 for controlling operation of each of the first and second photocouplers 33 and 34.

The DC-DC converter 32 includes a transformer (high-frequency transformer) 43 including a primary-side coil 41 and a secondary-side coil 42, a primary-side circuit 44 for converting direct-current power from the power conversion unit 31 into alternating-current power and supply the converted alternating-current power to the primary-side coil 41, and a secondary-side circuit 45 for converting alternating-current power induced in the secondary-side coil 42 into direct-current power for supply to each brake coil 12.

The primary-side circuit 44 includes a first transistor (transistor on an upper arm (positive electrode) side) 46, which is a first switching element, and a second transistor (transistor on a lower arm (negative electrode) side) 47, which is a second switching element. The first and second transistors 46 and 47 are field-effect transistors (FETs).

The first transistor 46 is configured to perform an ON/OFF operation under the control of the drive signal (gate drive signal) from the first photocoupler 33. The second transistor 47 is configured to perform an ON/OFF operation under the control of the drive signal (gate drive signal) from the second photocoupler 34. The primary-side circuit 44 is configured to convert direct-current power from the power conversion unit 31 into alternating-current power to be supplied to the primary-side coil 41 by alternately performing the ON/OFF operations of the first and second transistors 46 and 47. When the drive signal of anyone of the first and second photocouplers 33 and 34 has stopped (has been cut), operation of the DC-DC converter 32 is stopped, and direct-current power stops being generated in the secondary-side circuit 45.

The first and second photocouplers 33 and 34 each include a light-emitting element and a light-receiving element. Further, the first and second photocouplers 33 and 34 are each configured to produce a drive signal by allowing the conduction of the light-receiving element with light emitted by the light-emitting element.

The converter control device 37 is configured to control operation of each of the first and second photocouplers 33 and 34 so that the drive signals from the first and second photocouplers 33 and 34 are alternately output by alternately emitting light and extinguishing light from the light-emitting elements of the first and second photocouplers 33 and 34 to repeat conduction and non-conduction of the light-receiving elements.

The first and second power supply control circuits 35 and 36 are configured to independently control the power supply voltages of the first and second photocouplers 33 and 34, respectively. In other words, the circuit configuration for controlling the power supply voltage of each of the first and second photocouplers 33 and 34 has a dual circuit configuration. Therefore, operation of the DC-DC converter 32 is stopped by cutting the power supply of at least any one of the first and second photocouplers 33 and 34.

The safety control device 26 includes a first safety control central processing unit (CPU) (first calculation unit) 51 and a second safety control CPU (second calculation unit) 52. The electric safety chain signal S is independently input to each of the first and second safety control CPUs 51 and 52. As a result, the first and second safety control CPUs 51 and 52 are each configured to independently detect an abnormality in the elevator state when input of the electric safety chain signal S is stopped.

The first and second safety control CPUs 51 and 52 are configured to independently output to the first and second power supply control circuits 35 and 36 a periodically varying signal as a control signal. The first and second safety control CPUs 51 and 52 are configured to independently control the respective power supply voltages of the first and second photocouplers 33 and 34 by controlling operation of the first and second power supply control circuits 35 and 36 based on the control signals.

The first power supply control circuit 35 is configured to control the power supply voltage of the first photocoupler 33 based on the control signal from the first safety control CPU 51. Further, the first power supply control circuit 35 is configured to periodically vary a value of the power supply voltage of the first photocoupler 33 based on the control signal from the first safety control CPU 51 while maintaining the value of the power supply voltage of the first photocoupler 33 at a higher value than a threshold at which operation of the first photocoupler 33 stops (i.e., a value at a level at which there is no hindrance to operation of the first photocoupler 33).

The second power supply control circuit 36 is configured to control the power supply voltage of the second photocoupler 34 based on the control signal from the second safety control CPU 52. Further, the second power supply control circuit 36 is configured to periodically vary a value of the power supply voltage of the second photocoupler 34 based on the control signal from the second safety control CPU 52 while maintaining the value of the power supply voltage of the second photocoupler 34 at a higher value than a threshold at which operation of the second photocoupler 34 stops (i.e., a value at a level at which there is no hindrance to operation of the second photocoupler 34).

The power supply voltage of each of the first and second photocouplers 33 and 34 is input as a monitoring signal to both the first and second safety control CPUs 51 and 52. As a result, each of the first and second safety control CPUs 51 and 52 monitors the power supply voltage of the first photocoupler 33 and the power supply voltage of the second photocoupler 34. The first and second safety control CPUs 51 and 52 are each configured to monitor the first and second power supply control circuits 35 and 36 and monitor the other of the first safety control CPU 51 or the second safety control CPU 52 by monitoring whether or not the power supply voltage of each of the first and second photocouplers 33 and 34 is periodically varying based on the control signals.

Figure 3:
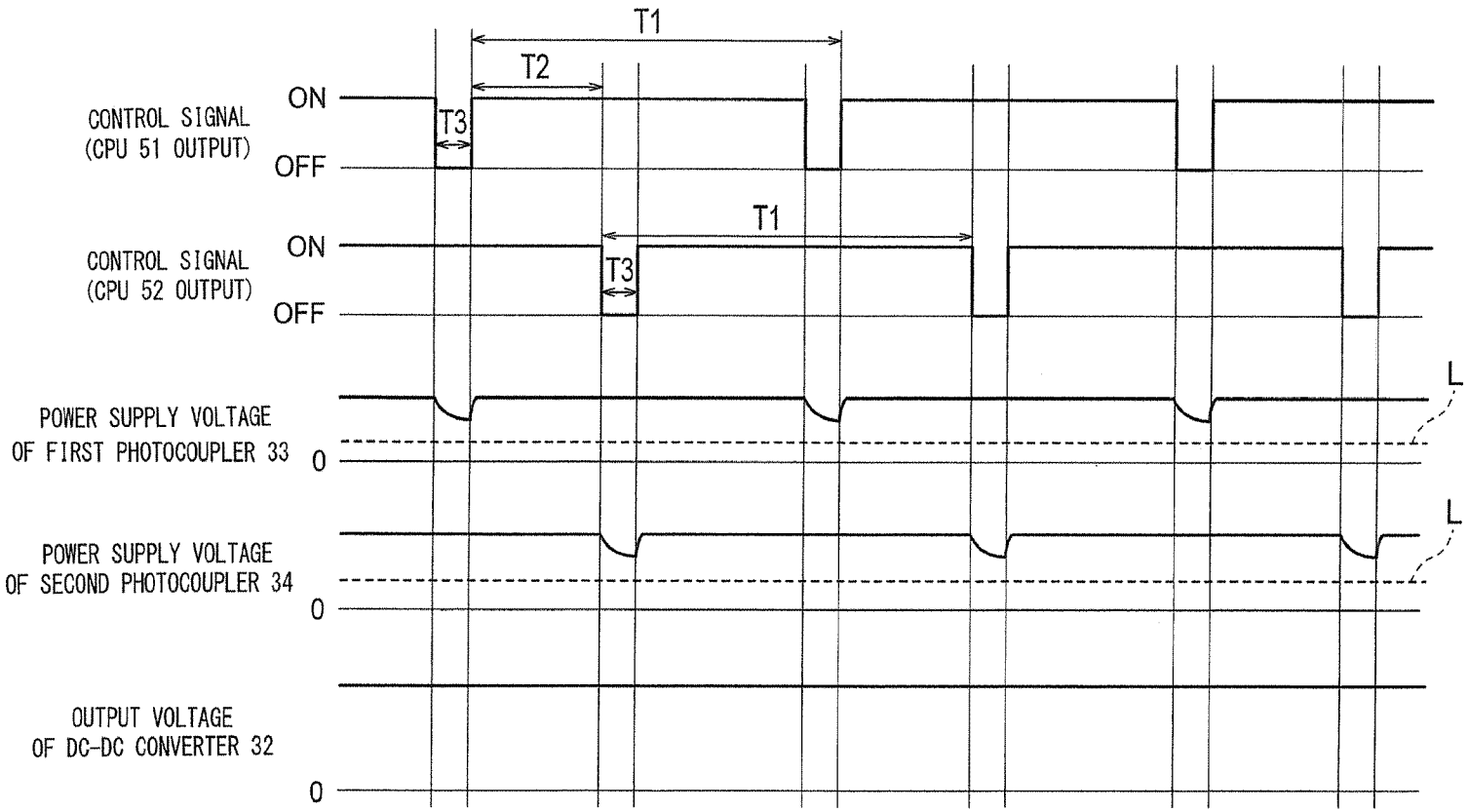
FIG. 3 is a graph for showing changes over time during normal operation in control signals of first and second safety control CPUs, power supply voltages of first and second photocouplers, and an output voltage of a DC-DC converter, illustrated in FIG. 2, respectively.

FIG. 3 is a graph for showing changes over time during normal operation in the control signals of the first and second safety control CPUs 51 and 52, the power supply voltages of the first and second photocouplers 33 and 34, and the output voltage of the DC-DC converter 32, illustrated in FIG. 2, respectively. The control signal from the first safety control CPU 51 is a signal repeating at a period T1 a change that stops output for a time T3. The control signal from the second safety control CPU 52 is a signal that, after the control signal of the first safety control CPU 51 has restarted, stops output for the time T3 after a defined time T2, which is a shorter time than the period T1. In other words, the control signal from the second safety control CPU 52 is a signal that offsets the change period by the time T2 with respect to the control signal from the first safety control CPU 51.

The time T3 during which the control signals from the first and second safety control CPUs 51 and 52 are stopped is set as a short time during which the power supply voltages of the first and second photocouplers 33 and 34 do not fall below a threshold L at which operation of the first and second photocouplers 33 and 34 stops.

During normal operation, the first and second safety control CPUs 51 and 52 are each configured to constantly monitor that the first and second power supply control circuits 35 and 36 are operating normally based on the fact that the power supply voltage of each of the first and second photocouplers 33 and 34 varies in synchronization with the control signals. As a result, during normal operation, output of the periodically varying control signals is continued by the first and second safety control CPUs 51 and 52, and the output voltage of the secondary-side circuit 45 of the DC-DC converter 32 is produced normally.

Figure 4:
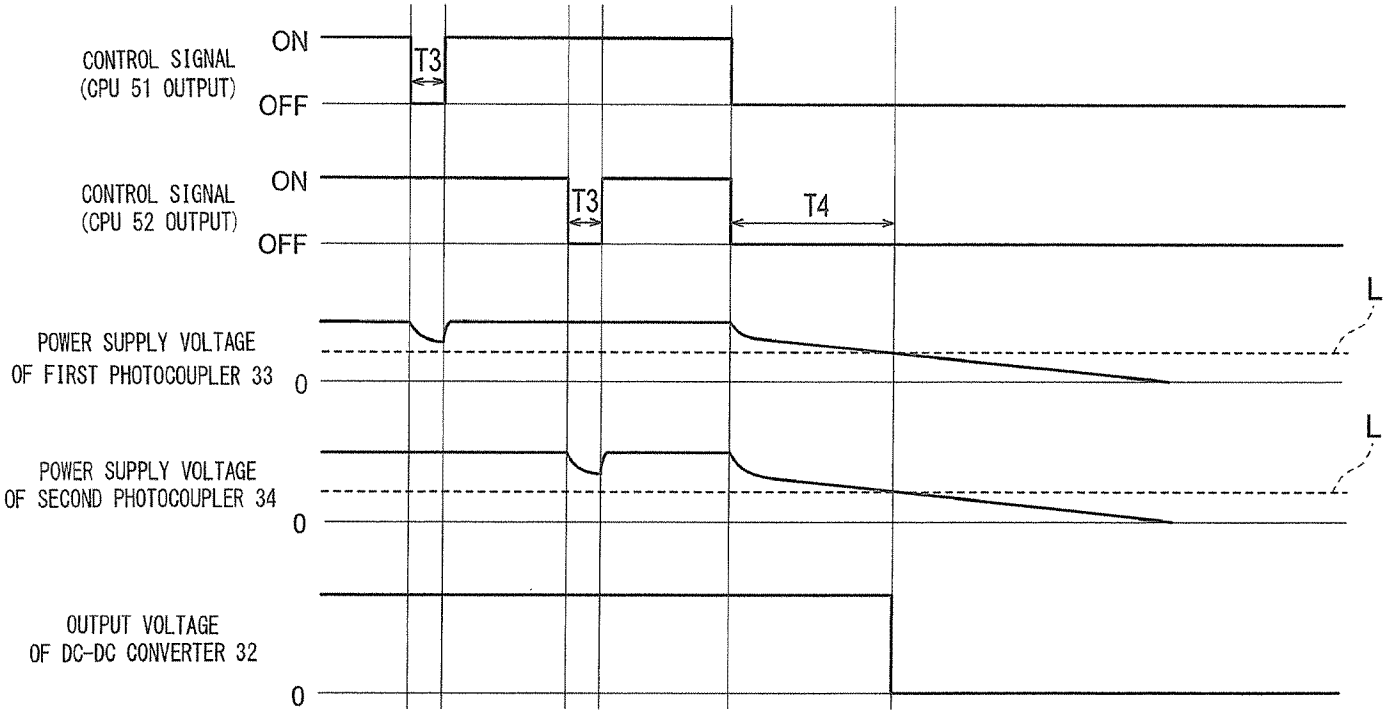
FIG. 4 is a graph for showing changes over time in the control signals of the first and second safety control CPUs, the power supply voltages of the first and second photocouplers, and the output voltage of the DC-DC converter, respectively, when an abnormality is detected based on stoppage of an electric safety chain signal illustrated in FIG. 2.

FIG. 4 is a graph for showing changes over time in the control signals of the first and second safety control CPUs 51 and 52, the power supply voltages of the first and second photocouplers 33 and 34, and the output voltage of the DC-DC converter 32, respectively, when an abnormality is detected based on stoppage of the electric safety chain signal S illustrated in FIG. 2. The first and second safety control CPUs 51 and 52 are configured to independently stop the control signal to each of the first and second power supply control circuits 35 and 36 when an abnormality is detected based on stoppage of the electric safety chain signal S.

As a result, after control of the power supply voltages of the first and second photocouplers 33 and 34 by the first and second power supply control circuits 35 and 36 is stopped, and a fixed time T4 has elapsed, the value of the power supply voltages of the first and second photocouplers 33 and 34 decreases to a level lower than the threshold L, and operation of each of the first and second photocouplers 33 and 34 stops. Consequently, the signal of the converter control device 37 stops being transmitted to the first and second transistors 46 and 47 of the DC-DC converter 32, operation of the primary-side circuit 44 stops, and the output voltage of the secondary-side circuit 45 decreases to zero. As a result, the power supply to each brake coil 12 is stopped, and a braking operation by the brake 8 is performed.

Figure 5:
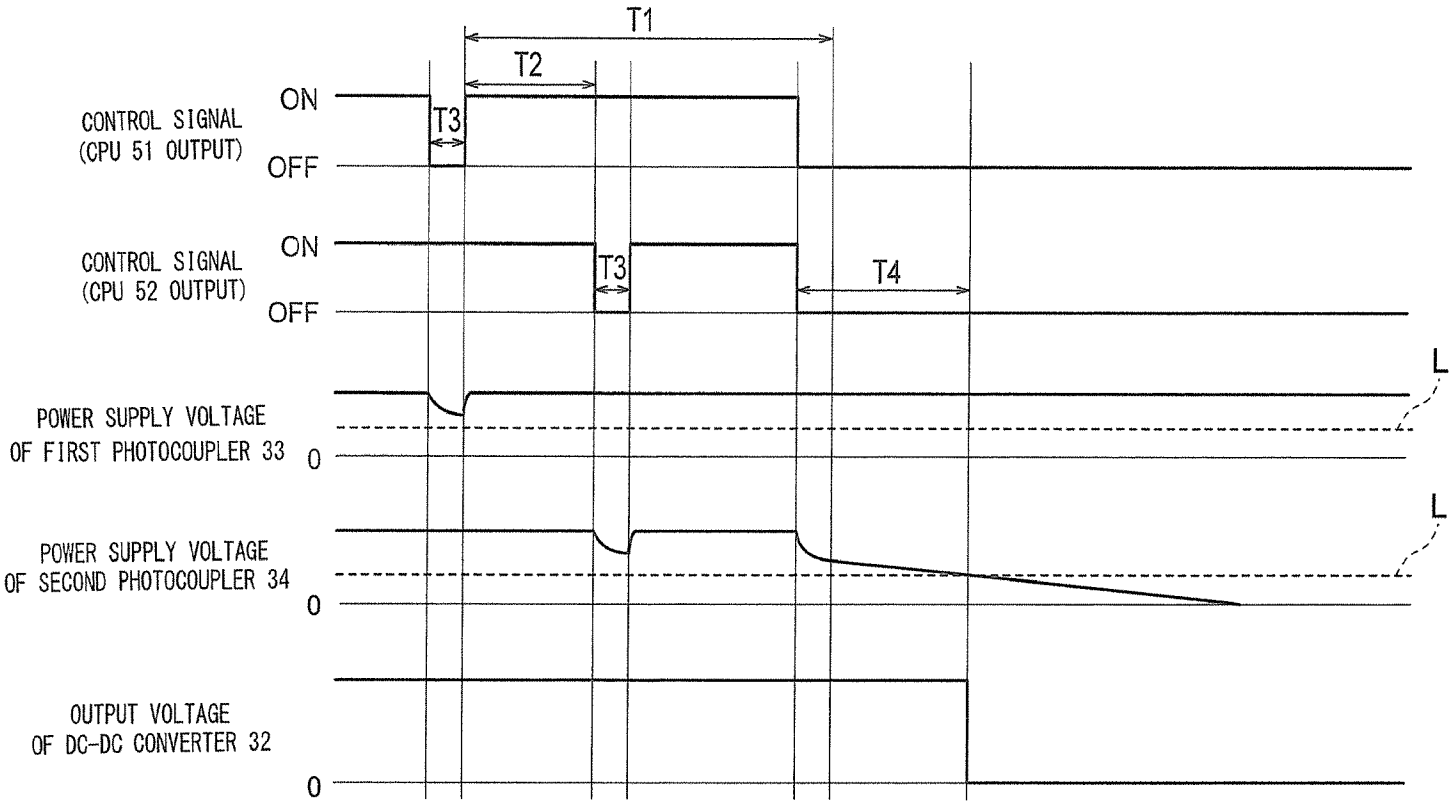
FIG. 5 is a graph for showing changes over time in the control signals of the first and second safety control CPUs, the power supply voltages of the first and second photocouplers, and the output voltage of the DC-DC converter, respectively, when a first power supply control circuit illustrated in FIG. 2 has suffered from an ON failure.

FIG. 5 is a graph for showing changes over time in the control signals of the first and second safety control CPUs 51 and 52, the power supply voltages of the first and second photocouplers 33 and 34, and the output voltage of the DC-DC converter 32, respectively, when the first power supply control circuit 35 illustrated in FIG. 2 has suffered from an ON failure. When an ON failure occurs in the first power supply control circuit 35, the power supply voltage of the first photocoupler 33 becomes a fixed value regardless of the control signal of the first safety control CPU 51. At this stage, the power supply voltage of the first photocoupler 33 does not vary in synchronization with the control signal of the first safety control CPU 51, and hence the first and second safety control CPUs 51 and 52 monitoring the power supply voltage of the first photocoupler 33 each detect an abnormality.

The first and second safety control CPUs 51 and 52 are each configured to immediately stop output of the control signal when an abnormality is detected. Because the first power supply control circuit 35 has suffered from an ON failure, the power supply voltage of the first photocoupler 33 is maintained as is without decreasing even though the control signal is stopped. However, the power supply voltage of the second photocoupler 34 falls below the threshold after the fixed time T4 has elapsed, and operation of the second photocoupler 34 stops. As a result, the signal of the converter control device 37 stops being transmitted to the second transistor 47 of the DC-DC converter 32, operation of the primary-side circuit 44 stops, and the output voltage of the secondary-side circuit 45 decreases to zero. Consequently, the power supply to each brake coil 12 stops, and a braking operation by the brake 8 is performed.

Even when an ON failure has occurred in the second power supply control circuit 36, each of the first and second safety control CPUs 51 and 52 is configured to detect an abnormality and stop output of the control signal, which causes the power supply voltage of the first photocoupler 34 to fall below the threshold, and operation of the first photocoupler 33 to stop. As a result, the signal of the converter control device 37 stops being transmitted to the first transistor 46 of the DC-DC converter 32, operation of the primary-side circuit 44 stops, and the output voltage of the secondary-side circuit 45 decreases to zero. Consequently, the power supply to each brake coil 12 stops, and a braking operation by the brake 8 is performed.

With such an elevator control apparatus 21, the first and second transistors 46 and 47 of the half-bridge DC-DC converter 32 are independently operated under the control of the first and second photocouplers 33 and 34, and the respective power supply voltages of each of the first and second photocouplers 33 and 34 are independently controlled by the first and second safety control CPUs 51 and 52. As a result, operation of the DC-DC converter 32 can be stopped by stopping only one of any one of the first and second photocouplers 33 and 34, which allows operation of the brake 8 to be more reliably controlled. Further, using the first and second photocouplers 33 and 34 allows contact points to be eliminated, and as a result, the occurrence of unwanted noise due to operation of the first and second photocouplers 33 and 34 can be prevented. In addition, using the first and second photocouplers 33 and 34 allows the size of the brake power supply device 25 to be reduced, and hence the size of the control apparatus 21 can be reduced.

Further, the first safety control CPU 51 is configured to perform a control for periodically varying the power supply voltage of the first photocoupler 33 so that operation of the first photocoupler 33 is not hindered, and to monitor the power supply voltage of each of the first and second photocouplers 33 and 34. Further, the second safety control CPU 52 is configured to perform a control for periodically varying the power supply voltage of the second photocoupler 34 so that operation of the second photocoupler 34 is not hindered, and to monitor the power supply voltage of each of the first and second photocouplers 33 and 34. As a result, an abnormality in the power supply voltage of each of the first and second photocouplers 33 and 34 can be detected more reliably, which allows the soundness of operation of the brake 8 to be even more reliably ensured.

Second Embodiment

Figure 6:
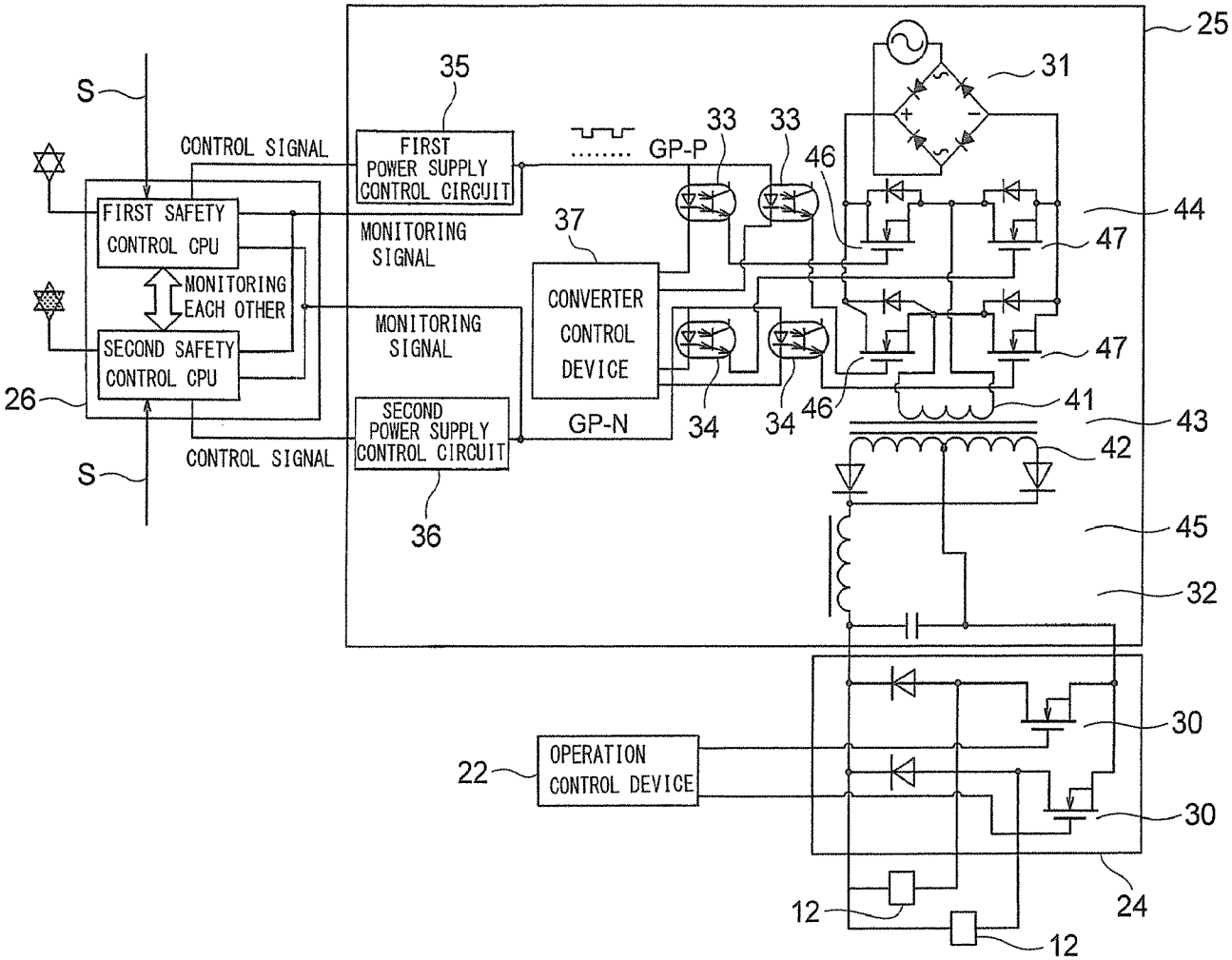
FIG. 6 is a configuration diagram for illustrating main parts of an elevator control apparatus according to a second embodiment of the present invention.

FIG. 6 is a configuration diagram for illustrating the main parts of an elevator control apparatus according to a second embodiment of the present invention. In FIG. 6, in this example, the DC-DC converter 32 is a full-bridge DC-DC converter. In other words, the primary-side circuit 44 of the DC-DC converter 32 includes a pair of first transistors (transistors on the upper arm (positive electrode) side) 46, and a pair of second transistors (transistors on the lower arm (negative electrode) side) 47. The first and second transistors 46 and 47 are the same as the first and second transistors 46 and 47 in the first embodiment.

Further, the brake power supply device 25 includes a pair of first photocouplers 33 for outputting drive signals (gate drive signals) to the pair of first transistors 46 in synchronization with each other, and a pair of second photocouplers 34 for outputting drive signals (gate drive signals) to the pair of second transistors 47 in synchronization with each other.

The pair of first transistors 46 are configured to perform an ON/OFF operation under the control of the drive signals (gate drive signals) from the first photocouplers 33. The pair of second transistors 47 are configured to perform an ON/OFF operation under the control of the drive signals (gate drive signals) from the second photocouplers 34. The primary-side circuit 44 is configured to convert direct-current power from the power conversion unit 31 into alternating-current power to be supplied to the primary-side coil 41 by alternately performing the ON/OFF operations of the pair of first transistors 46 and the ON/OFF operations of the pair of second transistors 47. When the drive signal of at least any one of the first and second photocouplers 33 and 34 has stopped (has been cut), operation of the DC-DC converter 32 is stopped, and direct-current power stops being generated in the secondary-side circuit 45.

The converter control device 37 is configured to control operation of each of the first photocouplers 33 and each of the second photocouplers 34 so that the drive signals from each of the pair of first photocouplers 33 and the drive signals from each of the pair of second photocouplers 34 are alternately output.

The first and second power supply control circuits 35 and 36 are configured to independently control the power supply voltages of the pair of first photocouplers 33 and the power supply voltages of the pair of second photocouplers 34. In other words, the circuit configuration for controlling the power supply voltages of the pair of first photocouplers 33 and the power supply voltages of the pair of second photocouplers 34 has a dual circuit configuration. Other parts and operations are the same as in the first embodiment.

Thus, even when the DC-DC converter 32 is a full-bridge DC-DC converter, the same advantageous effects as in the first embodiment can be obtained by providing the same number of first and second photocouplers 33 and 34 as the number of first and second transistors 46 and 47 of the DC-DC converter 32. In other words, operation of the brake 8 can be controlled more reliably, the occurrence of unwanted noise due to operation of the first and second photocouplers 33 and 34 can be prevented, and the size of the control apparatus 21 can be reduced.

The invention claimed is:

1. An elevator control apparatus, comprising:

a DC-DC converter comprising a first switching element and a second switching element, for generating power for driving an elevator brake by alternately operating each of the first switching element and the second switching element;

a first photocoupler and a second photocoupler for independently operating the first switching element and the second switching element, respectively; and a first calculation unit and a second calculation unit for independently controlling power supply voltages of the first photocoupler and the second photocoupler, respectively.

2. An elevator control apparatus according to claim 1, wherein the first calculation unit is configured to perform a control for periodically varying the power supply voltage of the first photocoupler so that operation of the first photocoupler is not hindered, and to monitor the power supply voltage of each of the first photocoupler and the second photocoupler, and wherein the second calculation unit is configured to perform a control for periodically varying the power supply voltage of the second photocoupler so that operation of the second photocoupler is not hindered, and to monitor the power supply voltage of each of the first photocoupler and the second photocoupler.

* * * * *